US008991410B2

(12) United States Patent
Surek et al.

(10) Patent No.: US 8,991,410 B2
(45) Date of Patent: Mar. 31, 2015

(54) PORTABLE CHAIR SHADE

(71) Applicant: Alysium Trading Co., Clarendon Hills, IL (US)

(72) Inventors: James Surek, Clarendon Hills, IL (US); Marinela Surek, Clarendon Hills, IL (US); Scott W. Beu, Bolingbrook, IL (US); Ronaldo J. Santiago, South Elgin, IL (US); Renato E. Imaña, Willowbrook, IL (US)

(73) Assignee: Alysium Trading Co., Clarendon Hills, IL (US)

( * ) Notice: Subject to any disclaimer, the term of this patent is extended or adjusted under 35 U.S.C. 154(b) by 0 days.

(21) Appl. No.: 13/774,582

(22) Filed: Feb. 22, 2013

(65) Prior Publication Data

US 2013/0221711 A1 Aug. 29, 2013

Related U.S. Application Data

(60) Provisional application No. 61/602,994, filed on Feb. 24, 2012.

(51) Int. Cl.
*A47C 7/66* (2006.01)
*E04H 15/58* (2006.01)

(52) U.S. Cl.
CPC ..... *A47C 7/66* (2013.01)
USPC ..... 135/96; 135/90; 135/117; 297/184.15; 5/414

(58) Field of Classification Search
CPC ..... E04H 15/48; E04H 15/02; E04H 15/003; E04H 15/64; A47C 7/66; A47C 4/00
USPC ..... 135/96, 90, 117, 907, 124–126; 297/184.1, 184.15, 184.17, 452.11, 297/452.13, 452.62, 354.1, 377, 353; 5/620, 627, 414–145; D6/361, D6/334–336
See application file for complete search history.

(56) References Cited

U.S. PATENT DOCUMENTS

| | | | | | |
|---|---|---|---|---|---|
| 2,137,427 | A | * | 11/1938 | Thomson | 297/23 |
| 3,675,667 | A | * | 7/1972 | Miller | 135/126 |
| 4,230,363 | A | * | 10/1980 | Borichevsky | 297/184.15 |
| 4,293,162 | A | * | 10/1981 | Pap et al. | 297/184.15 |
| 4,300,798 | A | * | 11/1981 | Musgrove et al. | 297/184.15 |
| 4,865,381 | A | * | 9/1989 | Van Rogue | 297/184.15 |
| 4,924,896 | A | | 5/1990 | Carter | |
| 4,971,089 | A | | 11/1990 | Braman | |
| 5,000,210 | A | * | 3/1991 | Worthington, Jr. | 135/90 |
| 5,135,281 | A | | 8/1992 | Pappalardo | |
| 5,154,473 | A | | 10/1992 | Joranco | |
| 5,441,067 | A | * | 8/1995 | James et al. | 135/96 |
| 5,593,205 | A | * | 1/1997 | Vanderminden et al. | 297/184.15 |
| D494,769 | S | | 8/2004 | Vigneaud | |
| 7,048,333 | B2 | | 5/2006 | Martinez | |
| 7,302,957 | B2 | | 12/2007 | Ross | |
| D594,241 | S | | 6/2009 | Bergmann et al. | |

(Continued)

*Primary Examiner* — Winnie Yip
(74) *Attorney, Agent, or Firm* — Vedder Price, P.C.

(57) ABSTRACT

A chair shade including a cover sheet, frame having a first end and a second end, a sliding unit simultaneously affixed to the cover sheet and slideably affixed to the frame such that the sliding unit moves along the length of the frame when a force is applied and maintains its position on the frame when no force is applied and a securing unit that secures the first end and second end of the frame to corresponding opposite sides of a chair.

14 Claims, 18 Drawing Sheets

(56) References Cited

U.S. PATENT DOCUMENTS

| | | | | |
|---|---|---|---|---|
| 7,708,339 | B2 | 5/2010 | Zapater | |
| 7,909,395 | B2 | 3/2011 | Reeb et al. | |
| 8,042,865 | B2 | 10/2011 | Fargason, III | |
| 2003/0056817 | A1 * | 3/2003 | Miller et al. | 135/117 |
| 2007/0018486 | A1 * | 1/2007 | Ayers et al. | 297/184.15 |
| 2008/0283105 | A1 | 11/2008 | DuBose, III | |
| 2009/0007947 | A1 | 1/2009 | Spangenberg | |
| 2010/0102600 | A1 | 4/2010 | Lovley, II | |
| 2011/0181078 | A1 | 7/2011 | Kelly et al. | |
| 2011/0303256 | A1 * | 12/2011 | Ashley | 135/117 |

* cited by examiner

PORTABLE CHAIR SHADE

RELATED APPLICATIONS

This application is a non-provisional patent application that claims the benefit of and the priority from U.S. Provisional Patent Application No. 61/602,994, filed Feb. 24, 2012, titled PORTABLE CHAIR SHADE.

BACKGROUND

Exposure to Ultraviolet (UV) light can have an adverse effect on personal health and appearance. Some of the adverse health effects include solar elastosis, a condition that manifests as thickened, coarse wrinkling, and yellow discoloration of the skin. Another effect of UV exposure is thinning of the skin that results in the formation of fine wrinkles, easy bruising of the skin, and tearing of the skin. Further, it is believed that exposure to UV light contributes to skin cancer.

Typically, people are exposed to UV light via the sun when they are engaging in leisure activities outdoors. For example, people may be exposed to large amounts of UV light when sunbathing or sitting outside. Many devices have been developed to protect people from UV light during leisure activities including umbrellas, tents, and rigid chair covers. However, these devices are typically rigid structures that are difficult to transport and assemble.

Based on these issues, a need exists for a chair shade that is portable, easy to assemble and effectively shades people from UV light.

SUMMARY OF THE INVENTION

One embodiment of a chair shade includes a cover sheet, a frame having a first end and a second end, a sliding unit simultaneously affixed to the cover sheet and slideably affixed to the frame such that the sliding unit moves along the length of the frame when a force is applied and maintains its position on the frame when no force is applied, and a securing unit that secures the first end and second end of the frame to corresponding opposite sides of a chair.

In another embodiment, the canopy may extend along substantially the entire length of the chair.

In another embodiment, the frame may have a substantially U shape.

In another embodiment, the cover sheet may include a support structure along the periphery of the cover sheet, and the support structure is affixed to the sliding unit.

In another embodiment, the cover sheet may be positioned at an angle relative to the sliding unit.

In another embodiment, the cover sheet may be made of a material that prevents the transmission of light.

In another embodiment, the cover sheet may be made of a tightly woven nylon.

In another embodiment, the support frame may be made of a material having memory characteristics.

In another embodiment, the securing unit may be a latch and hook strap.

In another embodiment, the support structure may be made of a material having a memory characteristic.

Another embodiment of a chair shade includes a cover sheet, a first support unit coupled to the cover sheet and at least two legs of a chair, a second support unit coupled to the cover sheet, at least two legs of the chair, and the first support unit, where the first support unit forms an arc along a first side of the chair, and the second support unit forms an arc along a second side of the chair.

In another embodiment, the first support unit and second support unit may each be secured to the ground.

In another embodiment, the chair shade may include a flap portion positioned in the cover sheet on each side of the chair shade.

In another embodiment, the first support unit and second support unit may be rods made of a material having memory characteristics.

In another embodiment, the first support unit and second support may be comprised of a plurality of interconnected rods.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
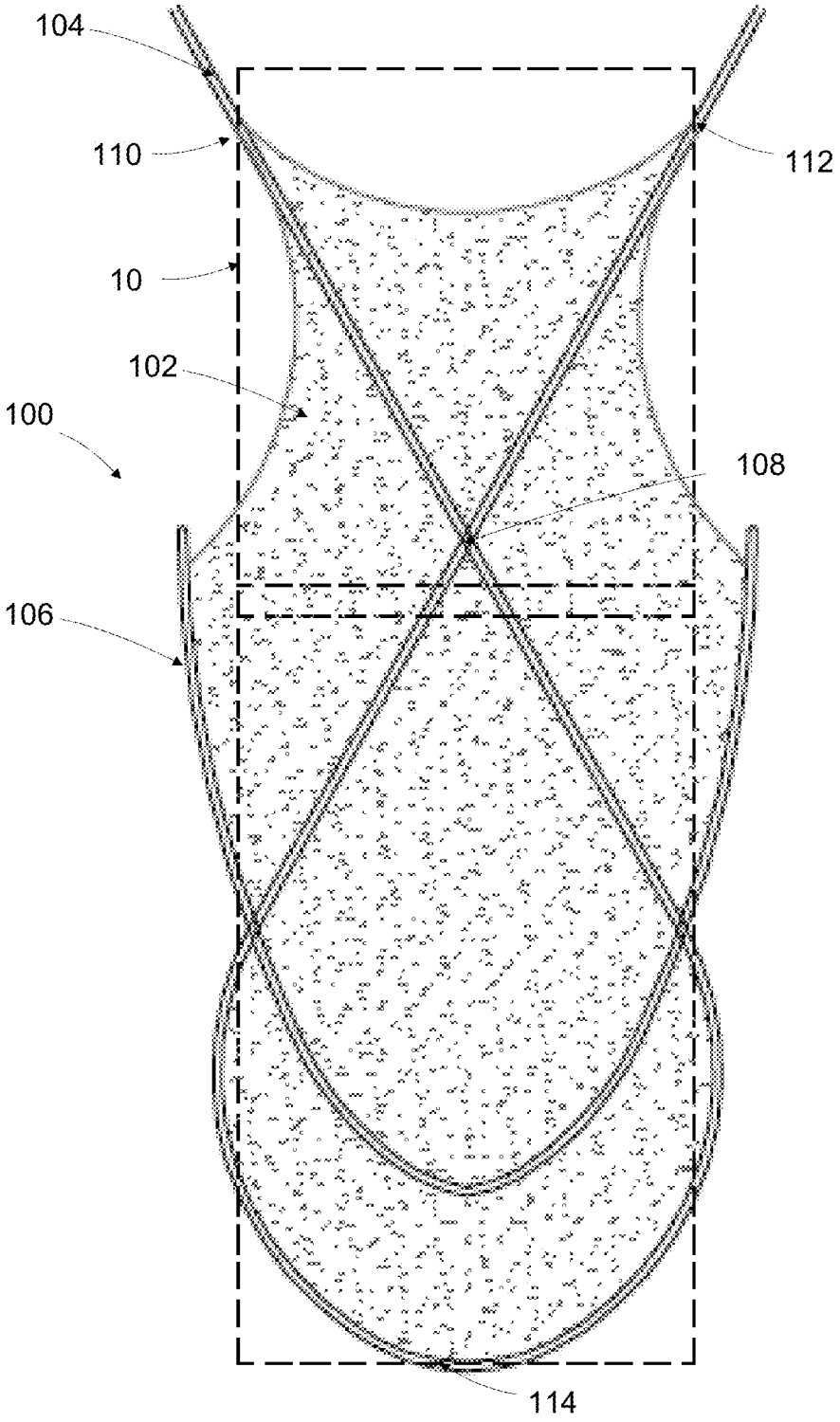
FIG. 1 depicts a top view of a chair shade.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 depicts a top view of a chair shade 100. The chair shade 100 includes a cover sheet 102, a first support unit 104, and a second support unit 106. The cover sheet 102 is configured to engage the first support unit 104 and second support unit 106 such that the shade 100 covers a portion of a chair 10. The cover sheet 102 is manufactured from a material having memory characteristics such as nylon, polyvinylchloride, polyester, rubber, or any other material having memory characteristics. The cover sheet 102 material may also prevent ultraviolet light from penetrating through the shade. The cover sheet 102 may be covered in a reflective coating, or may be coated with a material that reflects ultraviolet light.

The first support unit 104 and second support unit 106 are manufactured from a material having memory characteristics such as, but not limited to, fiberglass, rubber, plastic, or any other material having memory characteristics. The support units 104 and 106 may be manufactured from a plurality of shorter sections coupled together. The first support unit 104 and second support unit 106 may be secured to the cover sheet 102 using a sleeve attached to a surface of the cover sheet 102. The first support unit 104 and second support unit 106 may also be secured to the cover sheet 102 using a securing unit. The securing unit may be a latch or hook on the first support unit 104 that couples to a corresponding latch or hook on the surface of the cover sheet 102.

Returning to FIG. 1, the first support unit 104 is coupled to the cover sheet 102 such that a first section 110 of the first support unit 104 crosses over a second section 112 of the first support unit 104 at a position on the cover sheet 102. When the first section 110 and second section 112 of the first support unit 104 are crossed, a central portion 114 of the first support unit 104 is formed into an arc. The apex of the arc may correspond to the intersection 108 of the first support unit 104.

The first support unit 104 may be secured to the cover sheet 102 along a peripheral edge of the cover sheet 102. The first support unit 104 may also be secured to the cover sheet 102 by a sleeve formed in the material on the surface of the cover sheet 102. The sleeve may be formed by securing excess material on a peripheral end of the cover sheet 102 to a top, or bottom, surface of the cover sheet 102. The first support unit 104 may be threaded through the sleeve. By positioning the sleeve on the peripheral edge of the cover sheet 102, the cover sheet 102 is stretched taunt when the chair shade 100 is erected. The second support unit 106 may be secured to the cover sheet 102 using a sleeve or hook and latches in the same manner as the first support unit 104.

The ends of the second support unit 106 are configured to attach to the legs of a chair 10 such that the second support unit 106 forms an arc around the chair 10. The second support unit 106 may be positioned such that the ends of the second support unit 106 are positioned along the same plane as the intersection point 108. The second support unit 106 and first support unit 104 may intersect on two sides of the chair 10. The first support unit 104 may be positioned between the cover sheet 102 and the second support unit 102 at the points where the second support unit 106 intersects the first support unit 104.

Figure 2:
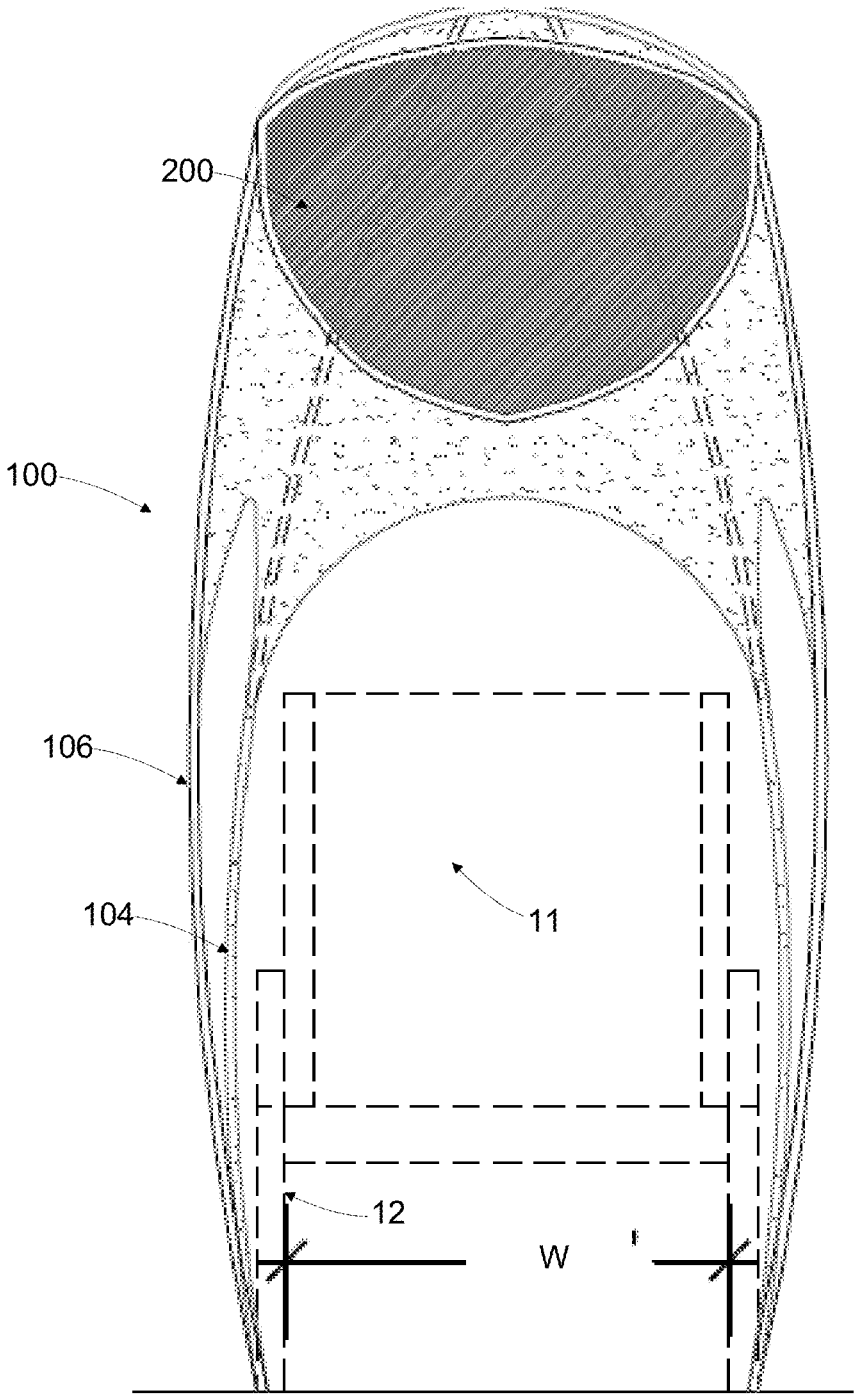
FIG. 2 depicts a front view of the chair shade of FIG. 1.

FIG. 2 depicts a front view of the chair shade 100. Each end of the second support unit 106 is connected to a corresponding front leg 12 of the chair 10 such that the second support unit 106 arcs across the width (w) of the chair 10. Further, the length of the second support unit 106 is selected such that the height of the arc of the second support unit 106 is higher than the back of the chair 10. Each end of the first support unit 104 is also secured to the corresponding rear legs 14 of the chair 10 in the same manner.

The first section 110 and second section 112 of the first support unit 104 are positioned on the side of the second support unit 106 such that the second support unit 106 prevents the first support unit 104 from moving in a direction away from the chair 10. The apex of the arc of the second support unit 106 may correspond to the intersection point 108 of the first section 110 and second section 112 of the first support unit 104, and the second support unit 116 may be secured to the first support unit 104 at the intersection of the two arms 104 and 106 at the apex of the arc of the second support unit 106.

A shading flap 200 may be affixed to the first support unit 104 at the central portion 114 of the first support unit 104. The shading flap 200 may be removable from the central portion 114, or may be permanently affixed to the central portion 114. The shading flap 200 may be manufactured of a material that reflects light. The shading flap 200 may also be coated with a coating that reflects light.

Figure 3A:
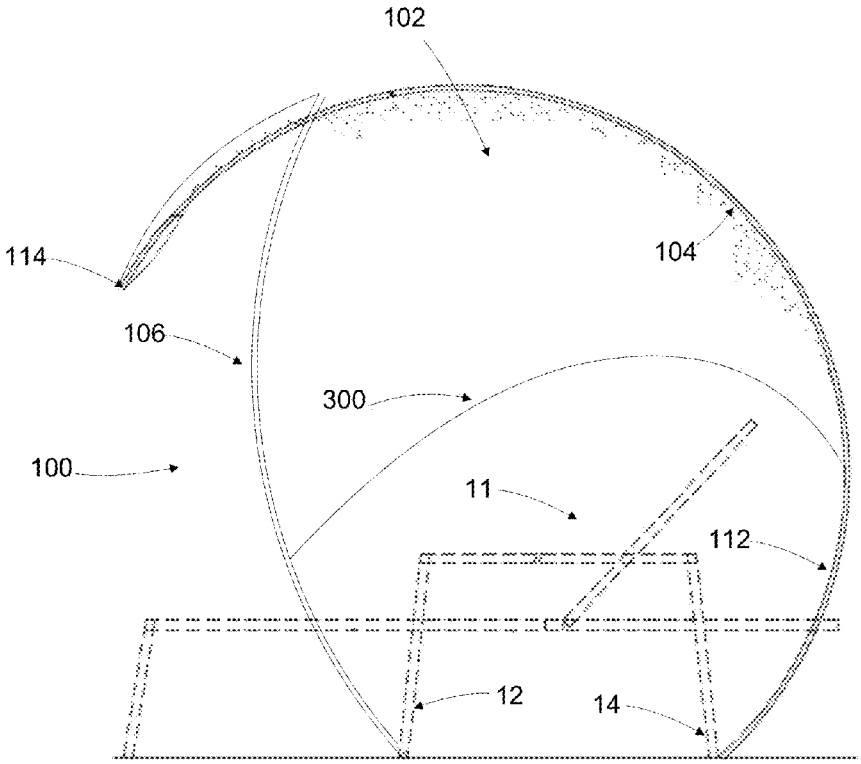
FIG. 3A depicts a side view of the chair shade of FIG. 1.

FIG. 3A depicts a side view of the chair shade 100. The cover sheet 102 is pulled over the seating portion of the chair 10 by the first support unit 104 and second support unit 106. Each support unit 104 and 106 is coupled to the cover sheet 102 using any of the methods previously discussed. The ends of the first section 110 and second section 112 of the first support unit 104 are each coupled to a back side of the rear legs 14 of the chair 10 to form an arc over the chair 10.

The second support unit 106 is coupled to the front side of two front legs 12 of the chair 10, and is positioned over the first support unit 106 such that the central portion 114 of the first support unit 106 is prevented from rotating back towards the first and second sections 110 and 112 of the first support unit 104. The second support unit 106 is coupled to the cover sheet 102 such that the memory characteristics of the second support unit 106 apply a force in a direction away from the first and second sections 110 and 112 of the first support unit 104. The second support unit 106 pulls the cover sheet 102 away from the first and second sections 110 and 112 of the first support unit 104, while the first support unit 104 pulls the cover sheet 102 towards the first and second sections 110 and 112 of the first support unit 104 thereby forming a canopy over the chair 10.

The apex of the second support unit 106 is coupled to the first support unit 104 by the cover sheet 102. Further, the central portion 114 of the first support unit 104 may extend beyond a plane created by the second support unit 106. The edges 300 of the cover sheet 102 on the sides of the chair shade 100 may be curved to provide air flow and light into the covered area of the chair 100.

Figure 3B:
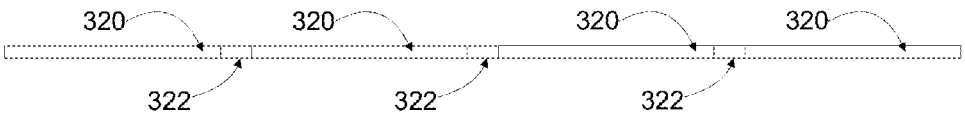
FIG. 3B depicts a rod used in the chair shade of FIG. 1.

FIG. 3B depicts a rod coupled with a plurality of rod coupling units 322 used to form the first support unit 104 and second support unit 106. The rod 318 includes a plurality of rod sections 320 with rod connecting units 322 connecting at least two rods together. The rod connecting units 322 may be configured such that a portion of each rod section 320 extends into opposing ends of the coupling unit 322 such that the rods are detachably affixed to one another.

The first support unit 104 and second support unit 106 may be coupled by a coupling unit 320 that prevents the first support unit 104 from moving relative to the second support unit 106. Further, the first support unit 104 and second support unit 106 may be comprised of a plurality of rods 318 connected together by rod coupling units 320. Each coupling unit 320 may also be incorporated into the securing units on the cover sheet 102.

Figure 3C:
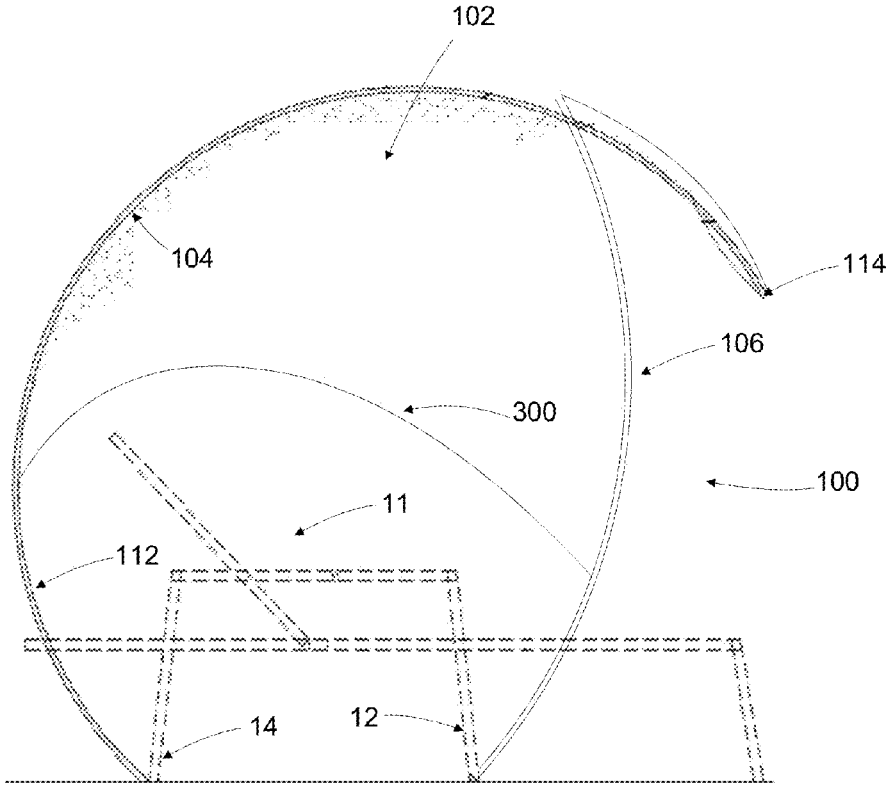
FIG. 3C depicts a side view of the chair shade of FIG. 1.
Figure 3D:
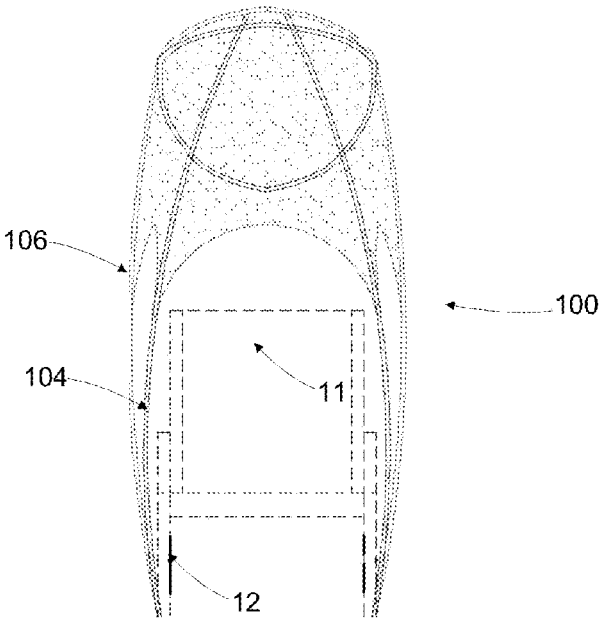
FIG. 3D depicts a rear view of the chair of FIG. 1.

FIG. 3C depicts a second side view of the chair 10 including the chair shade 100. FIG. 3D depicts a rear view of the chair 10 with the chair shade 100 attached.

Figure 4A:
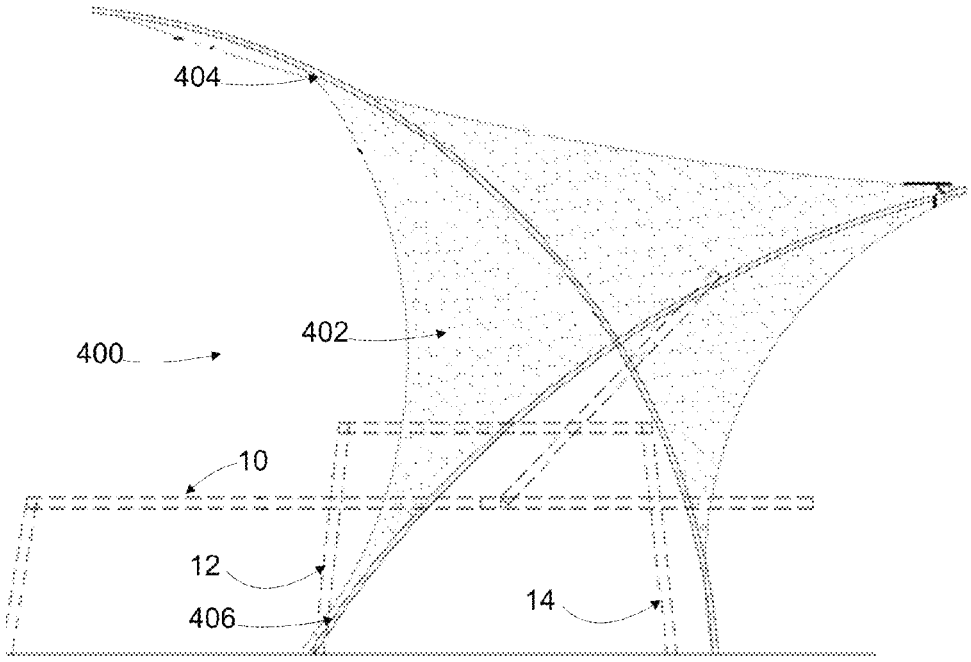
FIGS. 4A and 4B depict side views of a chair shade.
Figure 4B:
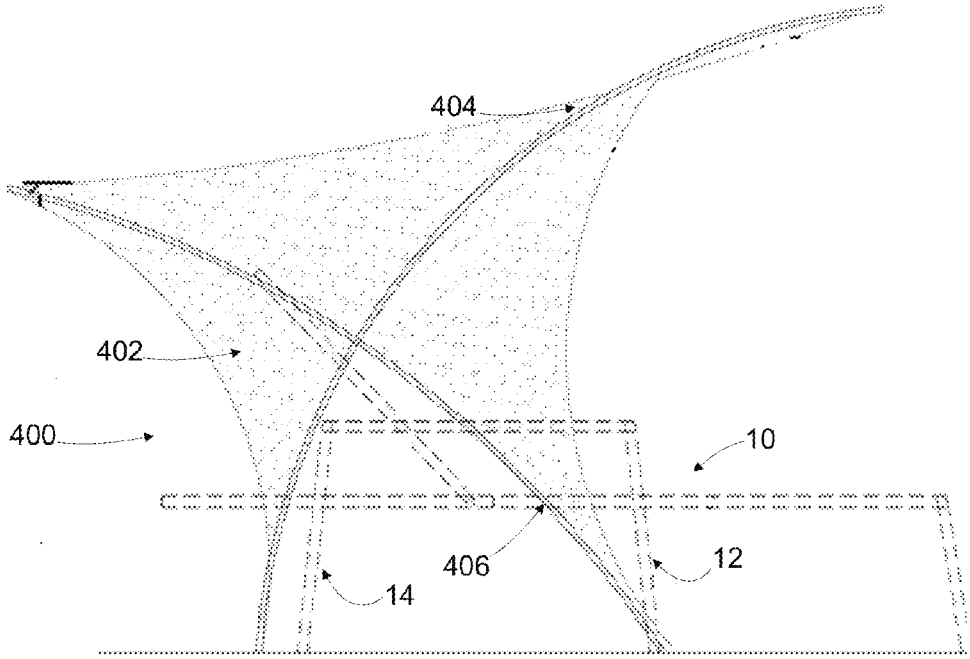

FIGS. 4A and 4B depict side views of a chair shade 400 in another embodiment of the present invention. The chair shade 400 is configured to cover a portion of the chair 10. The chair shade 400 includes a cover sheet 402. The cover sheet 402 is configured to engage a first support unit 404 and a second support unit 406 such that the shade covers a portion of the chair 10. The cover sheet 402 is made from a material having shading characteristics such as nylon, polyvinylchloride, polyester, rubber, or any other material having shading characteristics. The cover sheet 402 material may also prevent ultraviolet light from penetrating through the shade 400. The cover sheet 402 may be covered in a reflective coating, or may be coated with a material that reflects ultraviolet light.

The cover sheet 402 is supported over the chair 10 by the first support unit 404 and the second support unit 406. The first support unit 404 and second support unit 406 are made from a material having memory characteristics such as, but not limited to, fiberglass, rubber, plastic, or any other material having memory characteristics. The support units 404 and 406 may be made from a plurality of shorter sections coupled together as previously discussed. The first support unit 404 and second support unit 406 may be secured to the cover sheet 402 using a sleeve attached to a surface of the cover sheet 402. The first support unit 404 and second support unit 406 may also be secured to the cover sheet 402 using a securing unit. The securing unit may be a latch or hook on the first support unit 404 that couples to a corresponding latch or hook on the surface of the cover sheet 402.

The first support unit 404 and second support unit 406 are affixed along the periphery of the top surface of the cover sheet 402 and are bent such that they form an arc around the ends of the chair 10. Each end of the first support unit 404 is secured to the rear legs 14 of the chair 10 such that the first support unit 404 extends from the rear legs 14 of the chair 10 towards the front of the chair 10. Each end of the second support unit 406 is affixed to the front legs 12 of the chair 10 such that the second support unit 404 extends towards the back of the chair 10.

The first support unit 404 and second support unit 406 intersects on each side of the chair shade 400. The first support unit 404 and second support unit 406 may be coupled by a coupling unit that prevents the first support unit 404 from moving relative to the second support unit 406. Further, the first support unit 404 and second support unit 406 may be comprised of a plurality of rods connected together by rod coupling units as previously discussed. The coupling unit may be incorporated into a securing unit on the cover sheet 402.

Figure 4C:
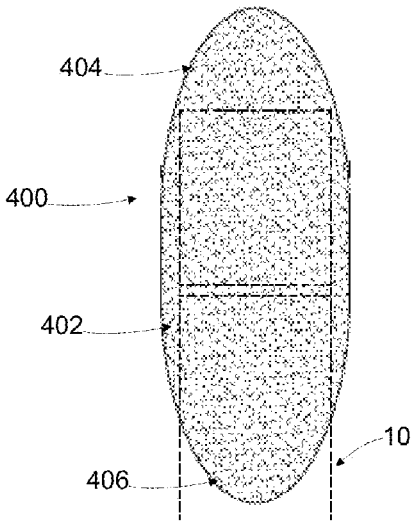
FIG. 4C depicts a top view of the chair shade of FIG. 4A.
Figure 4D:
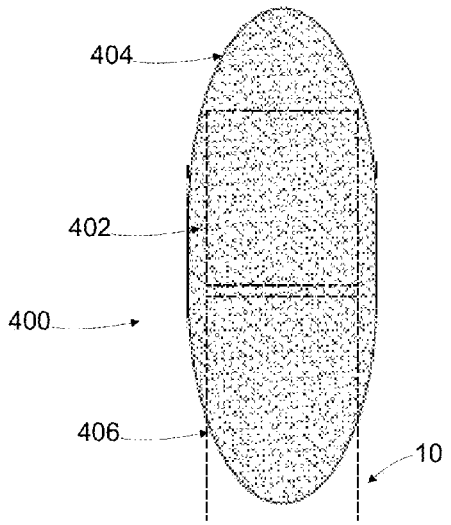
FIG. 4D depicts a bottom view of the chair shade of FIG. 4A.
Figure 4E:
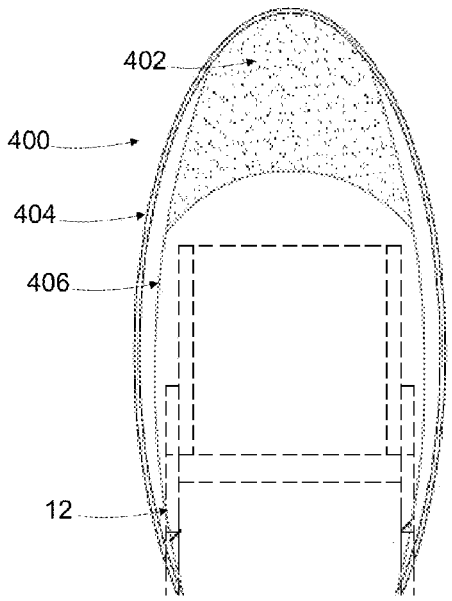
FIG. 4E depicts a front view of the chair shade of FIG. 4A.
Figure 4F:
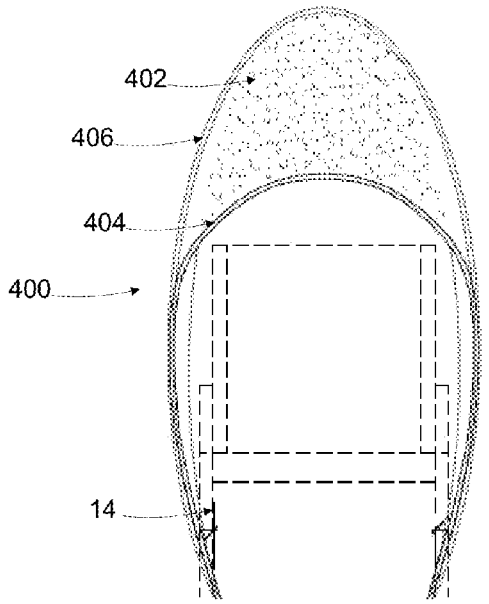
FIG. 4F depicts a rear view of the chair shade of FIG. 4A.

The first support unit 404 applies a force on the cover sheet 402 in a direction away from the chair 10, and the second support unit 406 applies a force on the cover sheet 402 in a direction away from the first support unit 404. Because of the counteracting forces applied by the first support unit 404 and the second support unit 406, the cover sheet 402 is pulled over the chair 10 such that a canopy structure is formed. FIGS. 4C and 4D depict top and bottom views of the chair shade 400. FIG. 4E depicts a front view of the chair shade 400, and FIG. 4F depicts a rear view of the chair shade 400.

Figure 5A:
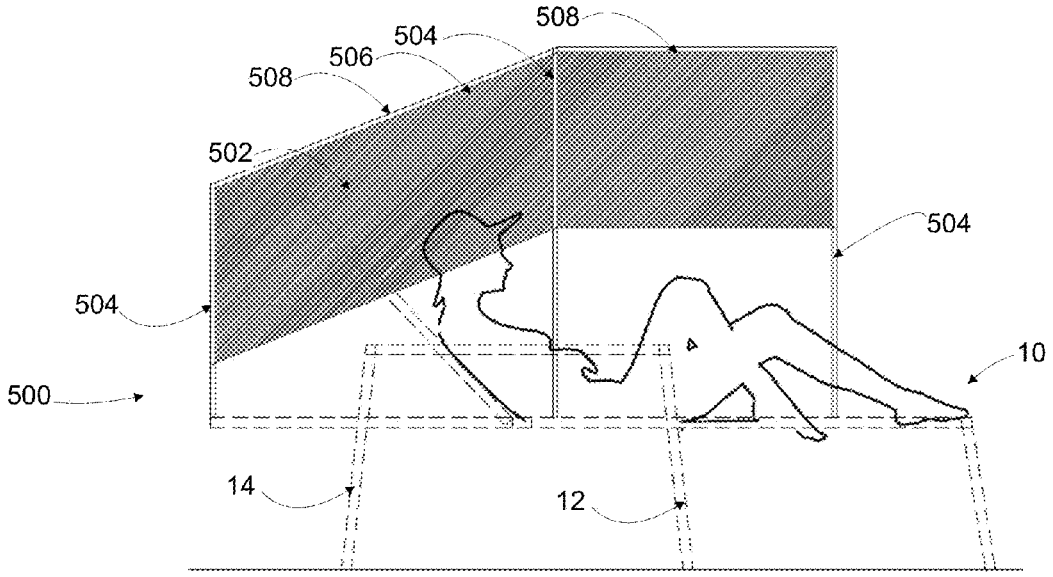
FIGS. 5A and 5B depict a side view of a chair shade.
Figure 5B:
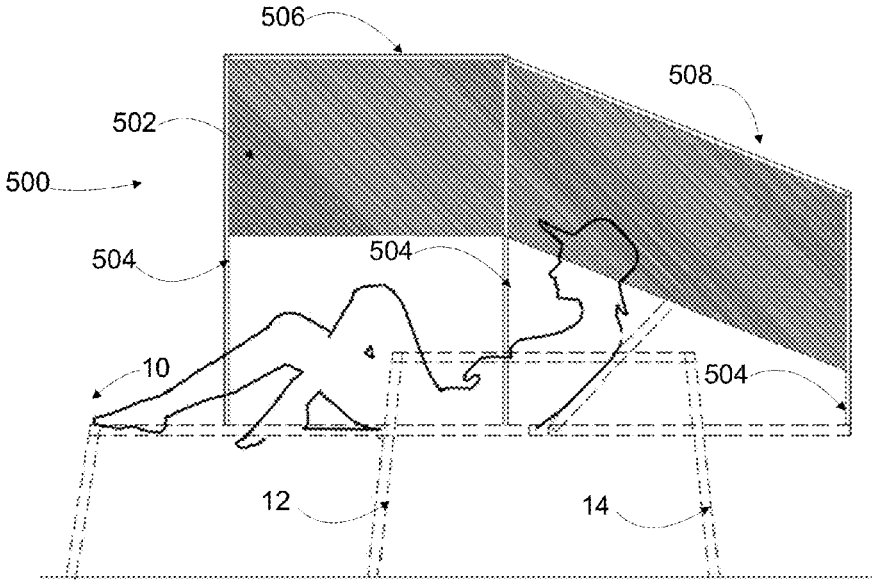

FIGS. 5A and 5B depict side views of a chair shade 500 in another embodiment of the present invention. The chair shade 500 includes a cover sheet 502 that is supported at six points by supporting units 504. Each of the supporting units 504 may have one end removably affixed to the cover sheet 502, and an opposite end removably affixed to a securing unit that is affixed to the top surface of the sides of the chair 10. The cover sheet 502 is sized such that the top portion of the cover sheet 502 that is located between the securing points, is slightly smaller than the width of the chair 10. Since the top portion of the cover sheet 502 is slightly smaller than the width of the chair 10, the top portion of the cover sheet is pulled taut when the cover sheet is connected to the chair 10 via the supporting units 504.

The supporting units 504 are made from a rigid material having memory characteristics, and are connected along a pocketed edge 506, or sleeve, in the cover sheet 502. Each of the supporting units 504 may include a pin positioned on the end of the cover sheet 502 that engages openings in the top portion of the cover sheet 502. The supporting units 504 may also be secured to the cover sheet 502 by sleeves in the cover sheet 502.

The sleeves may be arranged such that the supporting units 504 form a rigid frame when the supporting units 504 are slid into the sleeves. The rigid frame may include at least one horizontal supporting unit 508 that runs along an edge of the top portion of the cover sheet 502, such that the horizontal supporting unit 508 is parallel with the top surface of the chair 10. Each of the horizontal supporting units 508 are configured to engage at least one supporting unit 504 so that the horizontal supporting units 508 are supported above the top surface of the chair 10.

Figure 5C:
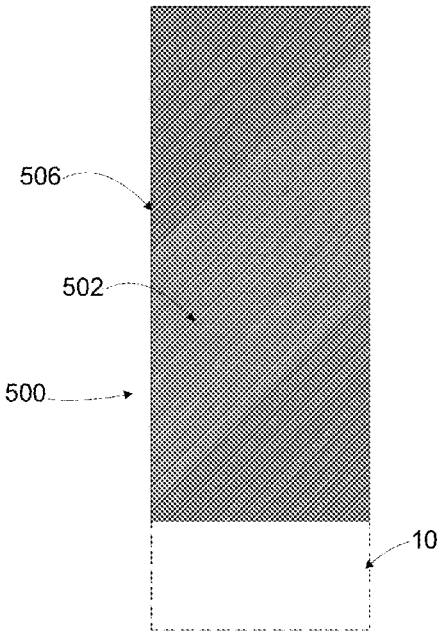
FIG. 5C depicts a top view of the chair shade of FIG. 5A.
Figure 5D:
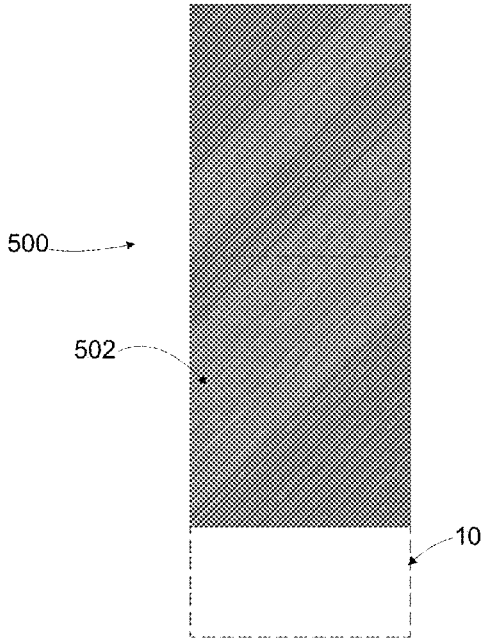
FIG. 5D depicts a bottom view of the chair shade of FIG. 5A.
Figure 5E:
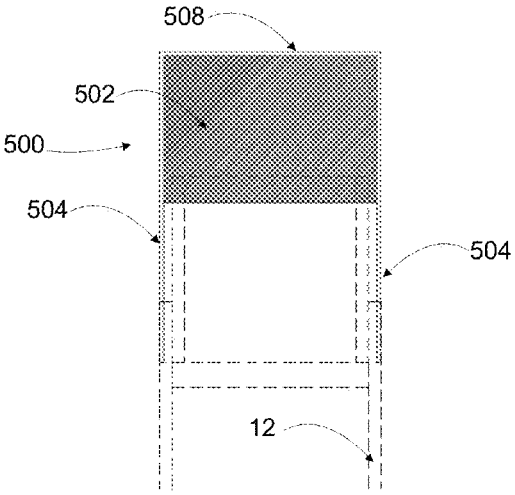
FIG. 5E depicts a front view of the chair shade of FIG. 5A.
Figure 5F:
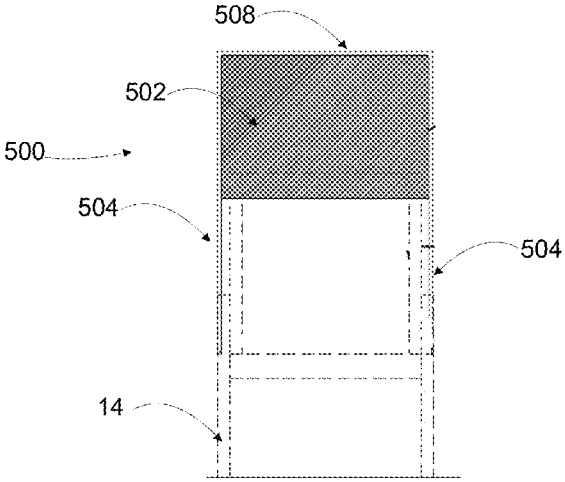
FIG. 5F depicts a rear view of the chair shade of FIG. 5A.

The portions of the cover sheet 502 between the supporting units 504 may be connected to the top surface of the cover sheet 502 only, and may be separated from adjacent portions of the cover sheet 502 between the other supporting units 504. The portions of the cover sheet 502 between the supporting units 504 may be configured such that each portion may be individually rolled up towards the top portion of the cover sheet 502, and secured in place by a strap. FIGS. 5C and 5D depict top and bottom views of the chair shade 500. FIGS. 5E and 5F depict front and rear views of the chair shade 500.

Figure 6A:
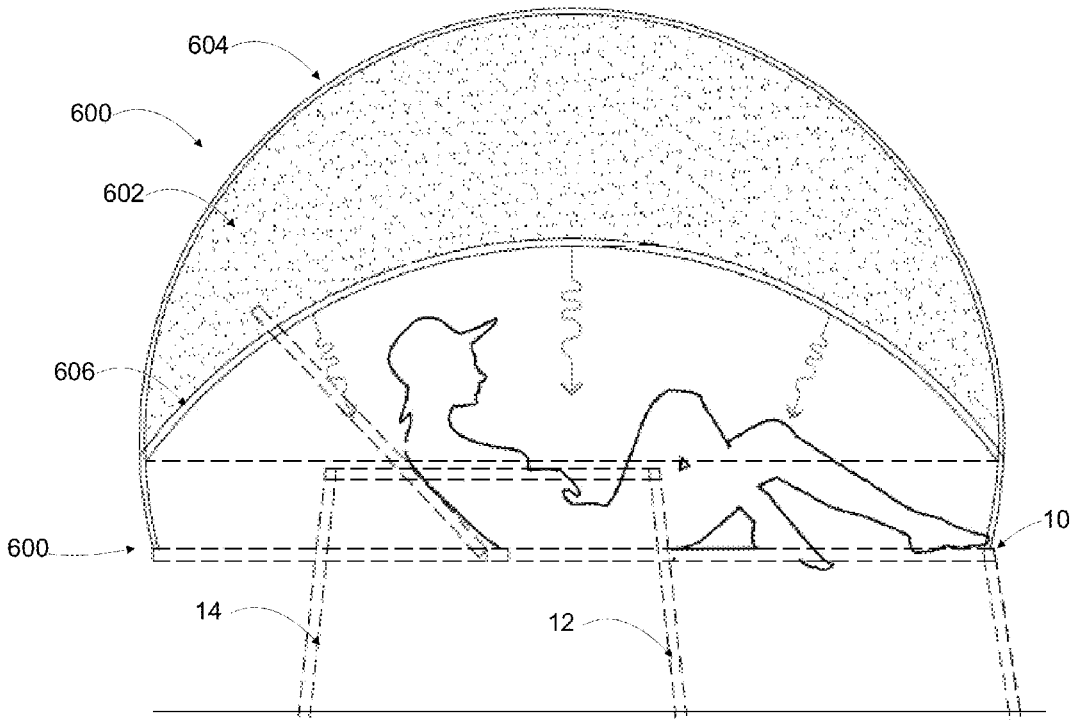
FIGS. 6A and 6B depict side views of a chair shade.
Figure 6B:
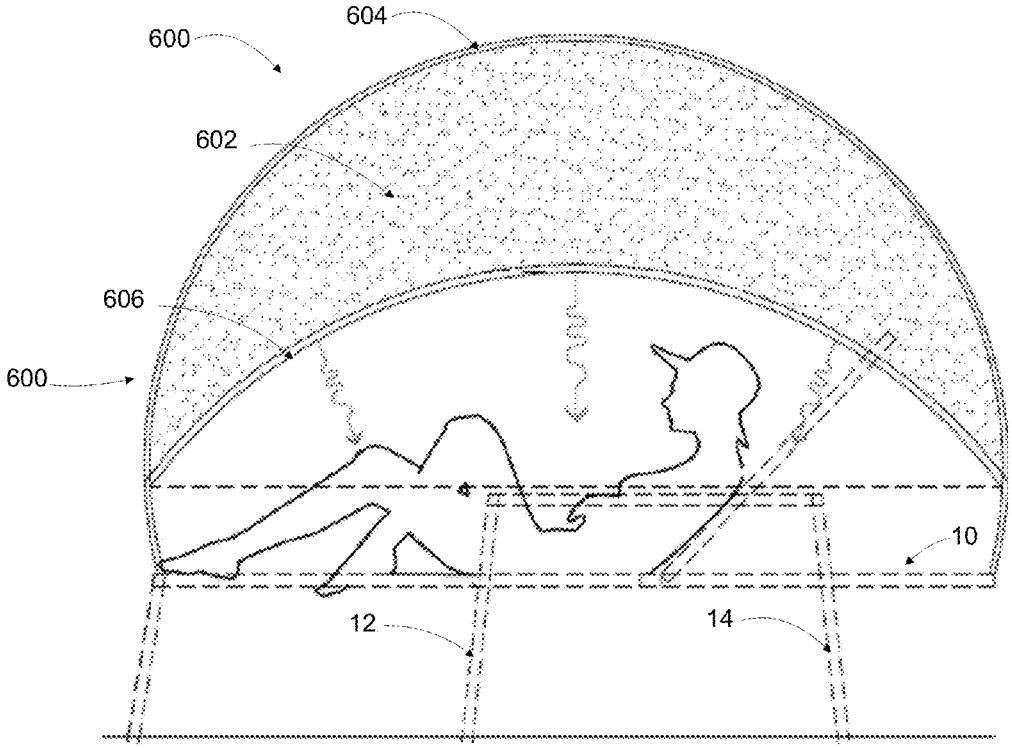

FIGS. 6A and 6B depict side views of a chair shade 600 in another embodiment of the present invention. The chair shade 600 includes a cover sheet 602, at least two first support units 604, and at least two second support units 606. The two first support units 604 are secured on opposite sides of the chair 10, and are secured to the cover sheet 602 along a top portion of the cover sheet 502. The support units 604 are made from a material having memory characteristics, and may be secured to the cover sheet 602 by a sleeve in the cover sheet 602. Both ends of the first support units 604 are secured to the chair 10 such that each support unit 604 forms an arc along the sides of the chair 10. Each second support unit 606 is secured to a lower edge of the cover sheet 602 with each end of each second support unit 606 being secured to the first support unit 604 such that the second support units 606 form an arc on each side of the chair.

The length of the cover sheet 602 is configured such that a user may apply a force against each second support unit 606 that causes the second support unit 606 to move towards the corresponding first support unit 604 causing the portion of the cover sheet 602 between the first support unit 604 and second support unit 606 to gather together.

Figure 6C:
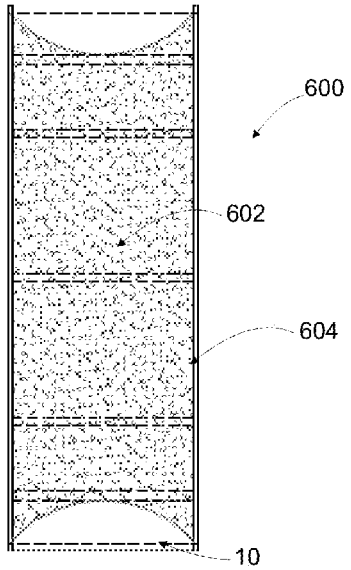
FIG. 6C depicts a top view of the chair shade of FIG. 6A.
Figure 6D:
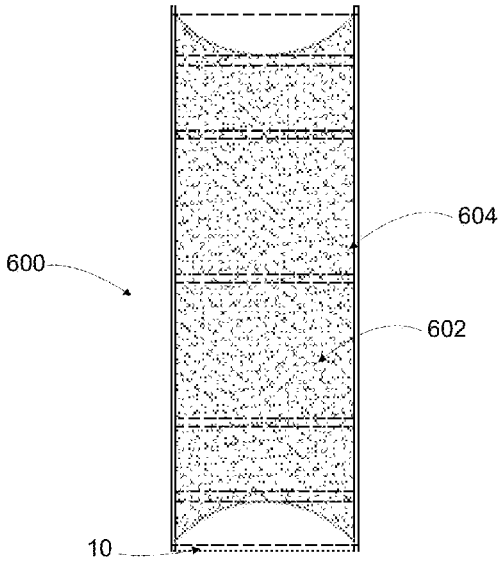
FIG. 6D depicts a bottom view of the chair shade of FIG. 6A.
Figure 6E:
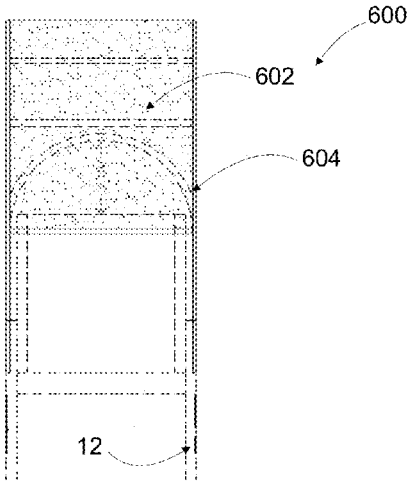
FIG. 6E depicts a front view of the chair shade of FIG. 6A.
Figure 6F:
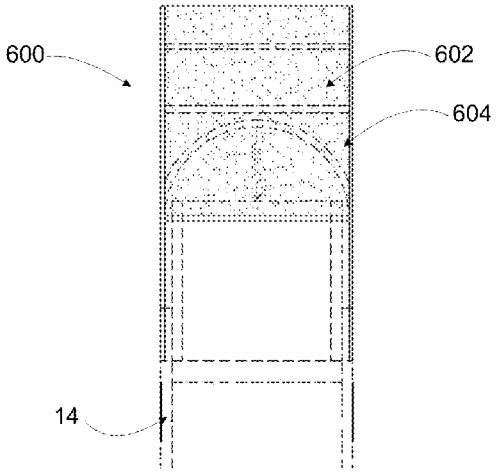
FIG. 6F depicts a rear view of the chair shade of FIG. 6A.

Conversely, the application of a force against each second support unit 606 in a direction away from each first support unit 604 causes the portion of the cover sheet 602 between the first support unit 604 and second support unit 606 to become taut. FIGS. 6C and 6D depict top and bottom views of the chair shade 600, and FIGS. 6E and 6F depict front and back views of the chair shade 600.

Figure 7A:
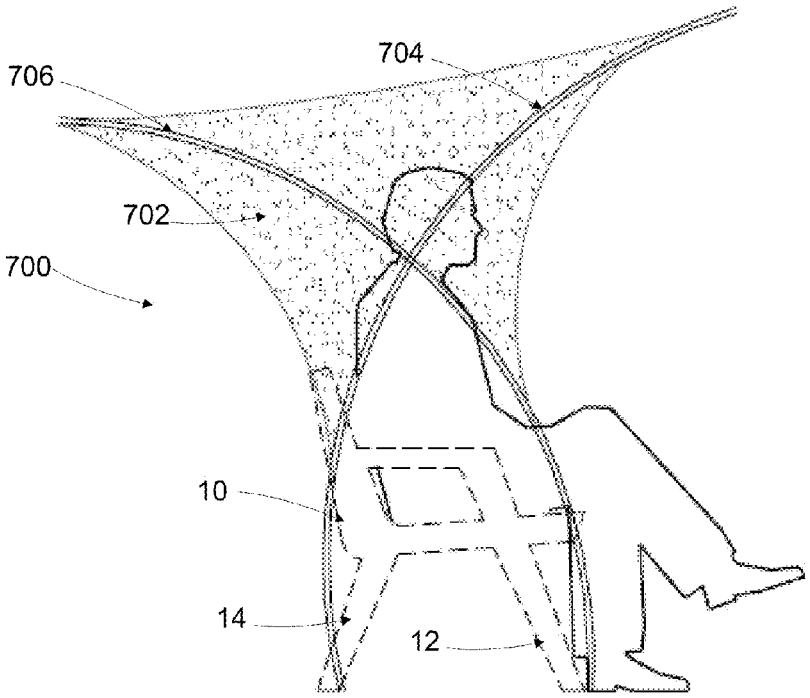
FIGS. 7A and 7B depict side views of a chair shade.
Figure 7B:
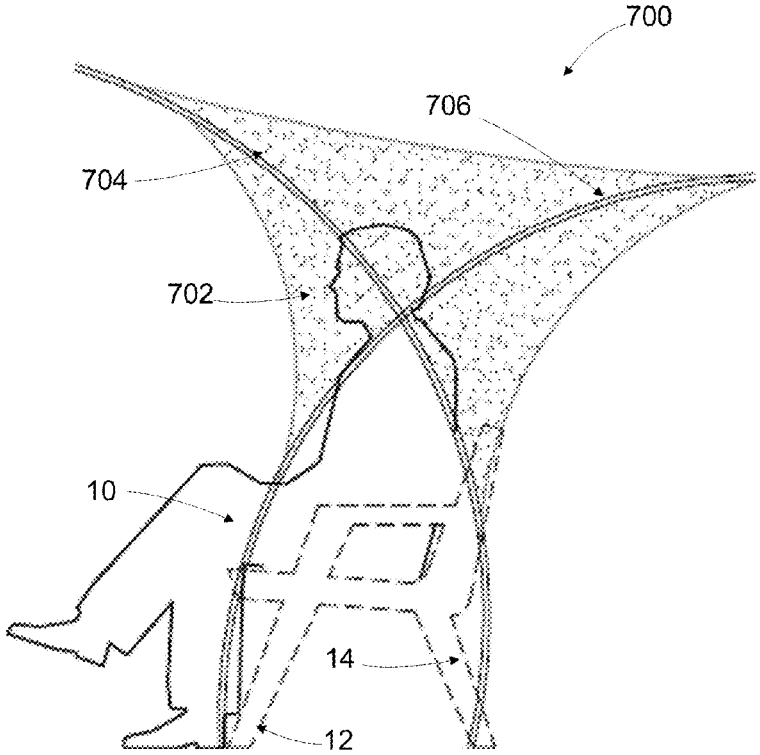

FIGS. 7A and 7B depict side views of a chair shade 700 in another embodiment of the present invention. The chair shade 700 is configured to cover a large portion of a chair 10. The chair shade 700 includes a cover sheet 702. The cover sheet 702 is configured to engage a first support unit 704 and a second support unit 706 such that the shade covers a portion of a chair 10. The cover sheet 702 is from a material having shading characteristics such as nylon, polyvinylchloride, polyester, rubber, or any other material having shading characteristics. The cover sheet 702 material may also prevent ultraviolet light from penetrating through the shade 700. The cover sheet 702 may be covered in a reflective coating, or may be coated with a material that reflects ultraviolet light.

The cover sheet 702 is supported over the chair 10 by the first support unit 704 and the second support unit 706. The first support unit 704 and second support unit 706 are made from a material having memory characteristics such as, but not limited to, fiberglass, rubber, plastic, or any other material having memory characteristics. The support units 704 and 706 may be made from a plurality of shorter sections coupled together. The first support unit 704 and second support unit 706 may be secured to the cover sheet 702 using a sleeve attached to a surface of the cover sheet 702. The first support unit 704 and second support unit 406 may also be secured to the cover sheet 702 using a securing unit. The securing unit may be a latch or hook on the first support unit 704 that couples to a corresponding latch or hook on the surface of the cover sheet 702.

The first support unit 704 and second support unit 706 are affixed along the periphery of the top surface of the cover sheet 702 and are bent such that they form an arc around the ends of the chair 10. Each end of the first support unit 704 is secured to the rear legs 14 of the chair 10 such that the first support unit 704 extends from the rear legs 14 of the chair 10 towards the front of the chair 10. Each end of the second support unit 706 is affixed to the front legs 12 of the chair such that the second support unit 704 extends towards the back of the chair 10.

The first support unit 704 and second support unit 706 intersect on each side of the chair shade 700, and are both coupled together by a coupling unit. The first support unit 704 and second support unit 706 may be coupled by a coupling unit that prevents the first support unit 704 from moving relative to the second support unit 706. Further, the first support unit 704 and second support unit 706 may be comprised of a plurality of rods connected together by rod coupling units. The coupling unit may be incorporated into a securing unit on the cover sheet 702.

Figure 7C:
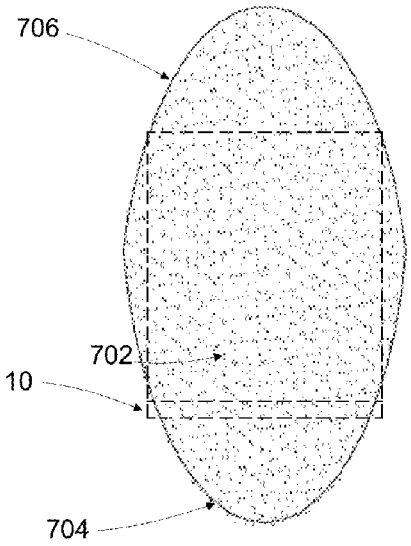
FIG. 7C depicts a top view of the chair shade of FIG. 7A.
Figure 7D:
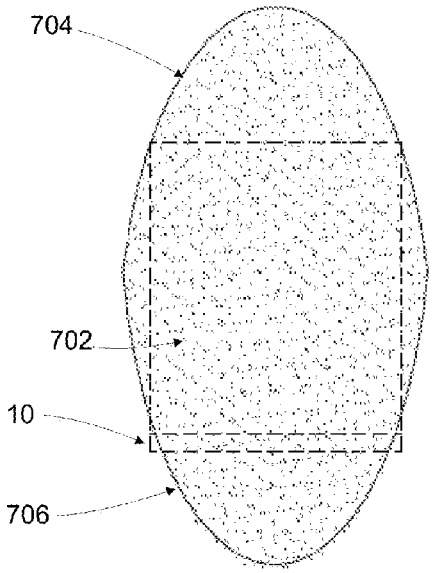
FIG. 7D depicts a bottom view of the chair shade of FIG. 7A.
Figure 7E:
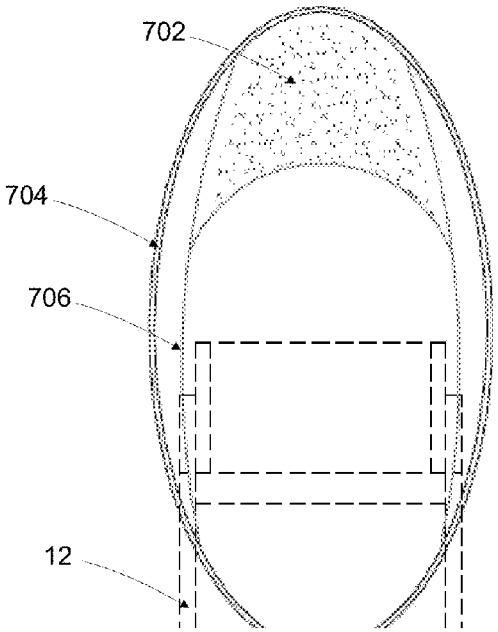
FIG. 7E depicts a front view of the chair shade of FIG. 7A.
Figure 7F:
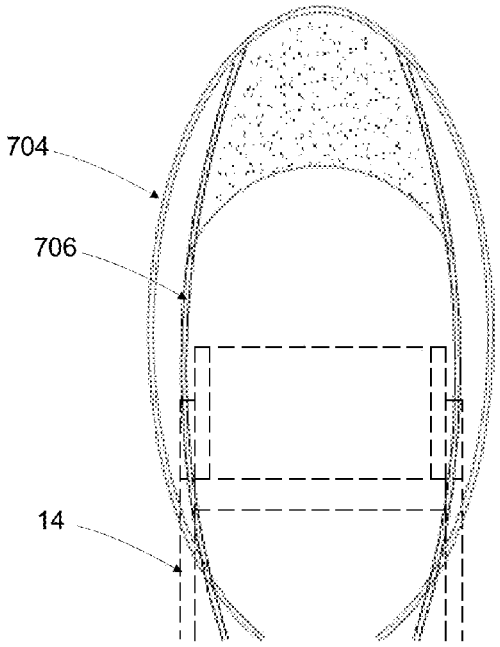
FIG. 7F depicts a rear view of the chair shade of FIG. 7A.

The first support unit 704 applies a force on the cover sheet 702 in a direction away from the chair 10, and the second support unit 706 applies a force on the cover sheet 702 in a direction away from the first support unit 704. Because of the counteracting forces applied by the first support unit 704 and the second support unit 706, the cover sheet 702 is pulled over the chair 10 such that a canopy structure is formed. FIGS. 7C and 7D depict top and bottom views of the chair shade 700. FIG. 7E depicts a front view of the chair shade 700. FIG. 7F depicts a rear view of the chair shade 700.

Figure 8A:
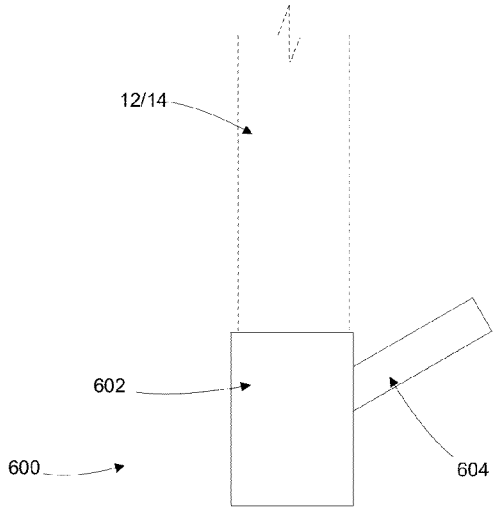
FIG. 8A depicts a securing unit that affixes a chair shade.

FIG. 8A depicts a securing unit that affixes a support unit 104, 106, 404, 406, 704, or 706 to the chair 10. The securing unit 800 includes a chair securing unit 802 that is sized to accommodate a leg 12 or 14 of the chair 10. A portion of the leg 12 or 14 of the chair 10 slides into the chair securing unit 802 preventing the chair leg 12 or 14 from moving. An angled securing unit 804 affixed to a side of the chair securing unit 802 engages an end of a support unit 104, 106, 404, 406, 704, or 706. Each end of each support unit 104, 106, 404, 406, 704, or 706 includes an opening that is sized to accommodate the angled securing unit 804. The length of each support unit 104, 106, 404, 406, 704, or 706 is sized such that the support unit 104, 106, 404, 406, 704, or 706 applies a force towards the end of the support unit 104, 106, 404, 406, 704, or 706 along the centerline of the support unit 104, 106, 404, 406, 704, or 706. Because each support unit 104, 106, 404, 406, 704, or 706 is made of a material having memory characteristics, each support unit 104, 106, 404, 406, 704, or 706 will attempt to straighten when bent, resulting in a substantially downward force, or a force having a component directed along the central axis of the securing unit 802, being applied to the chair securing unit 802.

Figure 8B:
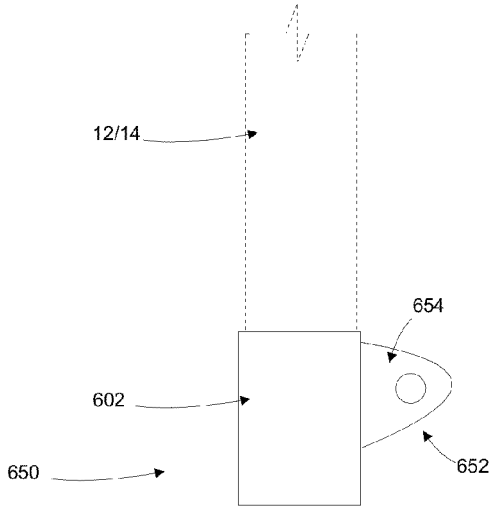
FIG. 8B depicts another securing unit affixed to a chair.

FIG. 8B depicts another securing unit 850 affixed to a chair 10. The securing unit 850 includes a chair securing unit 802 and a pin securing unit 852 affixed to a side of the chair securing unit 802. The pin securing unit 852 includes two support units 854 each affixed to the same side of the chair securing unit 802. The support units 854 are separated by a distance equal to or greater than the diameter of the support unit 104, 106, 404, 406, 704, or 706 such that the support unit 104, 106, 404, 406, 704, or 706 fits between the two support units. Each support unit 854 also includes an opening 856 sized to accommodate a pin unit (not shown). The openings 856 in each support unit 854 may be substantially circular and substantially concentrically aligned. The openings are also sized to accommodate an opening in an end of the support unit 104, 106, 404, 406, 704, or 706. To secure the securing units 104, 106, 404, 406, 704, or 706 to the support unit 854, the pin is inserted through the openings 856 and a corresponding opening in the end of the support unit 104, 106, 404, 406, 704, or 706.

The securing units 800 and 850 may also be secured to the shade without being secured to the chair 10. As an illustrative example, the securing units 800 and 850 may incorporate a stake that affixes the shade to the ground or other solid structure. The lower portion of the securing unit 800 and 850 may include a sharpened end that will allow the securing unit 800 and 850 to penetrate the surface of the solid structure.

As another illustrative example, the securing units 800 and 850 may be affixed to a weighted plate that holds the shade in place. The weighted plate may be positioned on one end of the securing unit 800 and 850, or along the length of the securing unit 800 and 850. The securing units 800 and 850 may also be configured to accommodate a plurality of weighted plates such that the amount of weight on each securing unit 800 and 850 may be varied. The weighted plates may be configured with an opening along the center of the plate which is sized to accommodate the upper portion of the securing units 800 and 850.

Figure 9A:
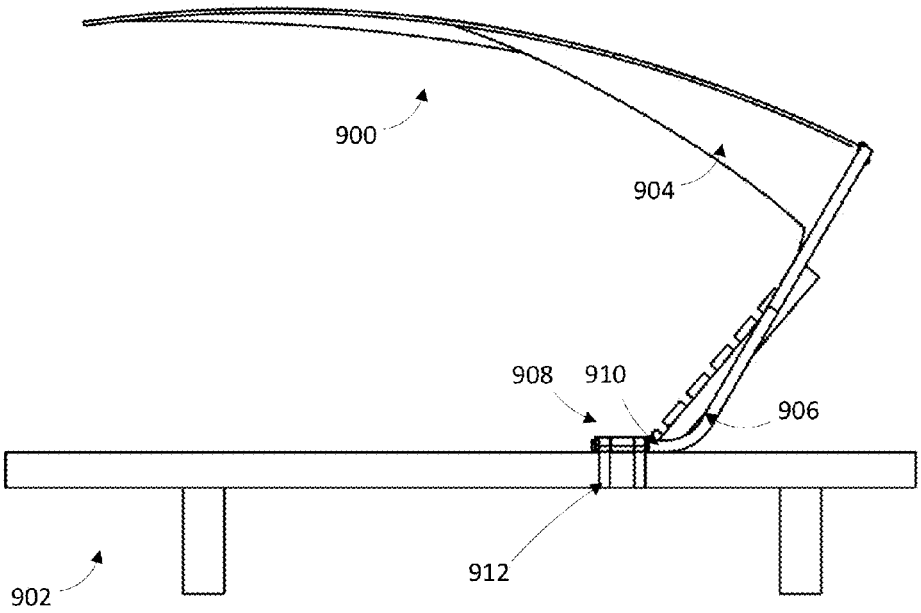
FIG. 9A depicts a side view of a chair shade.

FIG. 9A depicts a side view of a chair shade 900. The chair shade 900 is configured to affix to the arms or the base of a chair 902. The chair shade 900 includes an upper canopy 904 affixed to a frame 906. The frame 906 is substantially U-shaped having two opposing end portions 908 with each opposing end portion 908 being removably affixed to the chair 902. The frame 906 may be made from any rigid material including, but not limited to, steel, aluminum, plastic, fiberglass, or any other rigid material capable of supporting the canopy 904. Each end portion 908 may include an extension portion 910 that is substantially parallel to the base of the chair 902 when the frame 906 is affixed to the chair 902. A securing unit 912 engages the extension portion 910 and the base, or arm, of the chair 902 to secure the frame 906 to the chair 902. The securing unit 912 may be, but is not limited to, a pin and hole arrangement, a latch and hook strip, a rope, a wire, a leather strap or any other device capable of removably affixing the extension portion 910 to the chair 902.

Figure 9B:
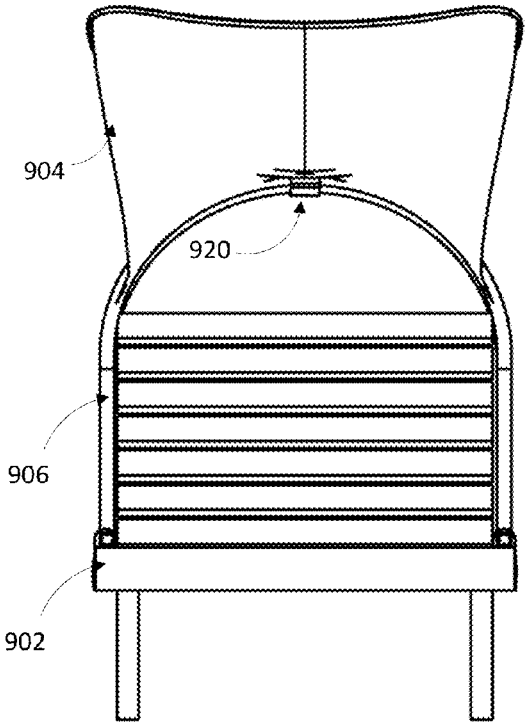
FIG. 9B depicts a rear view of the chair shade of FIG. 9A
Figure 9C:
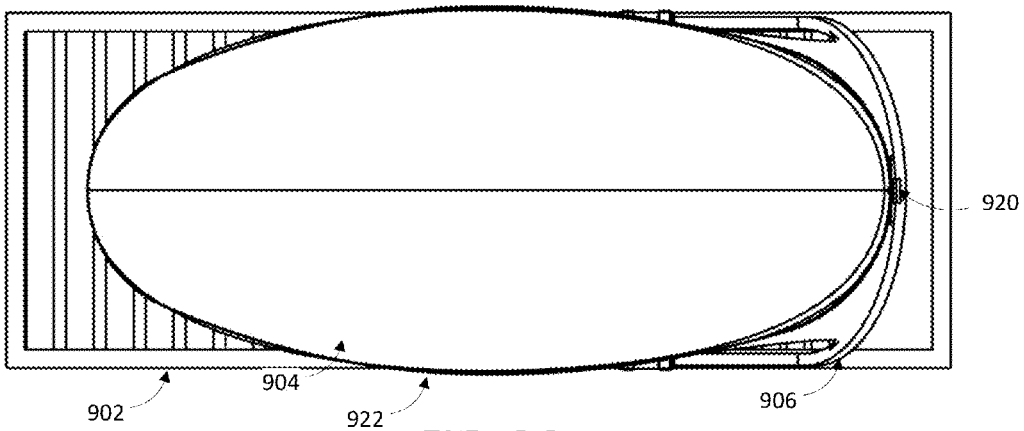
FIG. 9C depicts a top view of the chair shade of FIG. 9A.

FIG. 9B depicts a rear view of the chair shade 900. The canopy 904 is slideably secured to a portion of the frame 906 by a sliding unit 920. The sliding unit 920 simultaneously engages the canopy 904 and the frame 906 such that the sliding unit 920 may move freely along the length of the frame. FIG. 9C depicts a top view of the chair shade 900. The canopy 904 may be substantially elliptical in shape such that the canopy 904 extends across a substantial portion of the length of the chair 902. In another embodiment, the canopy 904 may extend the entire length of the chair 902. In another embodiment, the canopy may extend beyond the length of the chair 902.

The canopy 904 is made from a material having shading characteristics such as nylon, polyvinylchloride, polyester, rubber, or any other material having shading characteristics. In one embodiment, an upper surface, the surface opposite the surface facing the chair 902, of the canopy 904 includes photovoltaic material that is used to convert sunlight into electrical energy. Consistent with this embodiment, a battery pack including at least one rechargeable battery cell that is secured to the frame 906. The battery pack is electrically coupled to an electrical outlet that allows a user to power and recharge electrical devices. Electrical energy may be harnessed from the photovoltaic cells using any known method of harnessing and storing solar energy.

The canopy 904 may be formed by a support frame 922 inserted along the periphery of the canopy 904. The support frame 922 may be inserted into a loop formed along the periphery of the canopy 904 such that the support frame 922 stretches the canopy 904 between the support frame. The support frame 922 is made from a material having memory characteristics such as, but not limited to, fiberglass, rubber, plastic, or any other material having memory characteristics. The support frame 922 is configured such that, when extended, the canopy 904 is pulled flat under tension by the support frame 922. Further, the support frame 922 may be retracted to compress the canopy 904 into a predefined shape for transport of the canopy 904. As an illustrative example, the memory characteristics of the support frame 922 may form the canopy 904 into a substantially elliptical shape when open, and may compress the canopy 904 into at least two concentric circles when the sides of the support frame 922 are pushed towards one another.

Figure 9D:
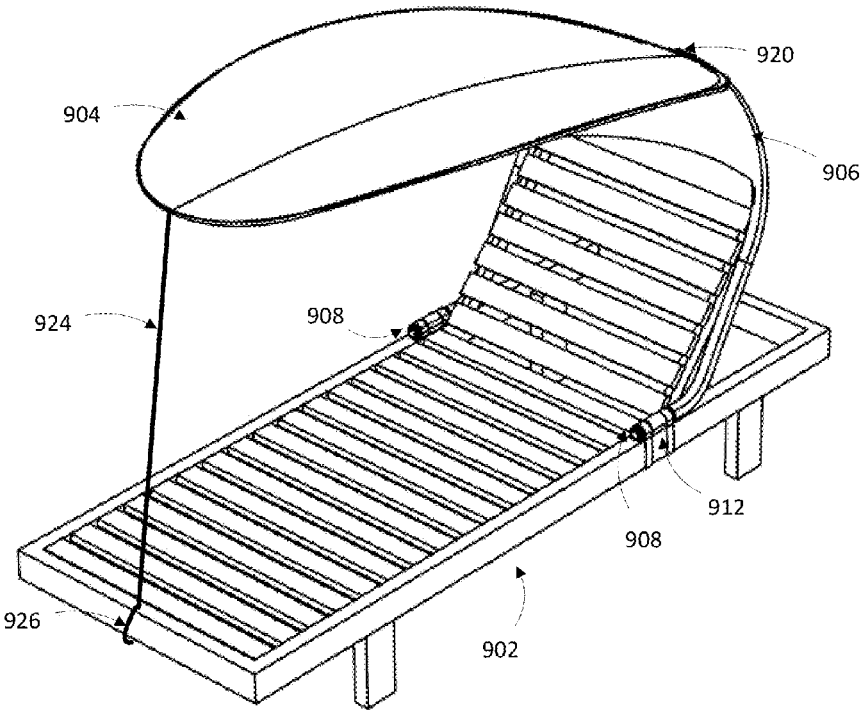
FIG. 9D depicts a perspective view of the chair shade of FIG. 9A.

FIG. 9D depicts a perspective view of the chair shade 900 on the chair 902. In one embodiment, the end of the canopy furthest from the frame 906 may be secured to an end of the chair 902 by a canopy securing unit 924. The canopy securing unit 924 may be a rod secured to the support structure 922 of the canopy 904 on one end and to the end of the chair furthest from the frame 906 on an opposite end. The canopy securing unit 924 may be a rod or bar made of any rigid material including, fiberglass, steel, plastic, or any other rigid material. The canopy securing unit 924 may be secured to the chair 902 by a latch affixed to the end of the securing unit, or by a strap 926 secured to the end of the securing unit attached to the chair 902.

Consistent with this embodiment, the strap 926 extends around a portion of the chair 902 securing the securing unit to the chair 902. The strap 926 may pass through an opening in the securing unit to connect the strap to the securing unit. The strap 926 may be a rope, latch and hook strap, or any other device capable of securing the securing unit to the chair. The canopy securing unit 924 may be secured to the support frame 922 of the canopy 904 by an opening in an end of the canopy securing unit 924 opposite the end connected to the chair 902. The support frame 922 may pass through the opening in the canopy securing unit 924, affixing the support frame 922 to the canopy securing unit 924. In another embodiment, the canopy securing unit 924 is a rope or string that is tied to the chair 902 and the support frame 922. In another embodiment, the canopy securing unit 924 is a rope that is tied to the chair 902 and secured to the support frame 922 by a ring affixed to the rope and the support frame 922.

Figure 9E:
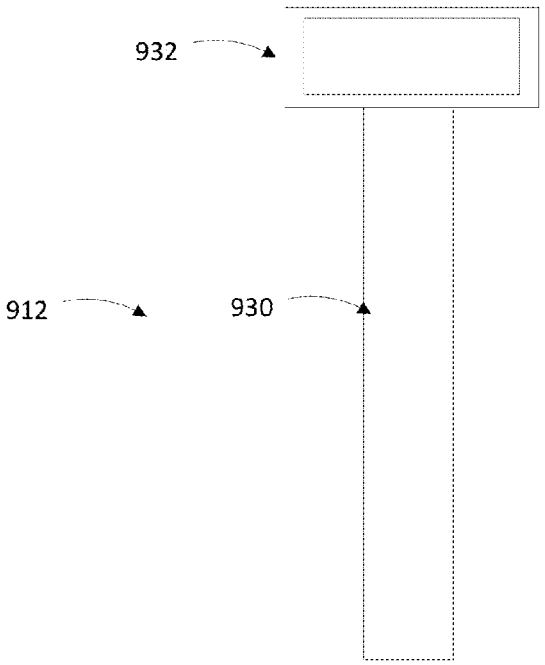
FIG. 9E depicts a front view of the securing unit of FIG. 1.

FIG. 9E depicts the securing unit 912 for securing the end portions of the frame 906 to the chair 902. The securing unit 912 includes a latch and hook strap 920 with one side of the latch and hook strap having substantially the entire surface covered with latches or hooks and an opposite side of the strap 920 having a portion less than the entire surface covered with latches or hooks. The strap 920 can be made of any material capable of securing the frame 906 to the chair 902 including, but not limited to, nylon, cotton, plastic, or any other material. An end portion of the strap 930 is permanently affixed to a loop 932 by a sleeve or any other securing mechanism. The loop 932 may be made from any rigid material such as metal or plastic. To secure the frame 906 to the chair 902, the strap 930 of the securing unit 912 is positioned around both the arm of the chair and the end portion 908 of the frame 906. The end of the strap 930 opposite the end of the strap 930 affixed to the loop 932 is threaded through the loop 932 such that a second loop is formed around the end portion 908 and the arm of the chair 902. The end of the strap 932 passing through the loop 932 is then pulled back such that the latch and hook on the end of the strap 932 engages the latch and hook on the portion of the strap 932 looped around. The frame 906 may be secured to the chair 902 using one securing unit 912 on each end portion 908. In another embodiment, the frame 906 is secured to the chair using at least two straps 932 on each end portion.

Figure 9F:
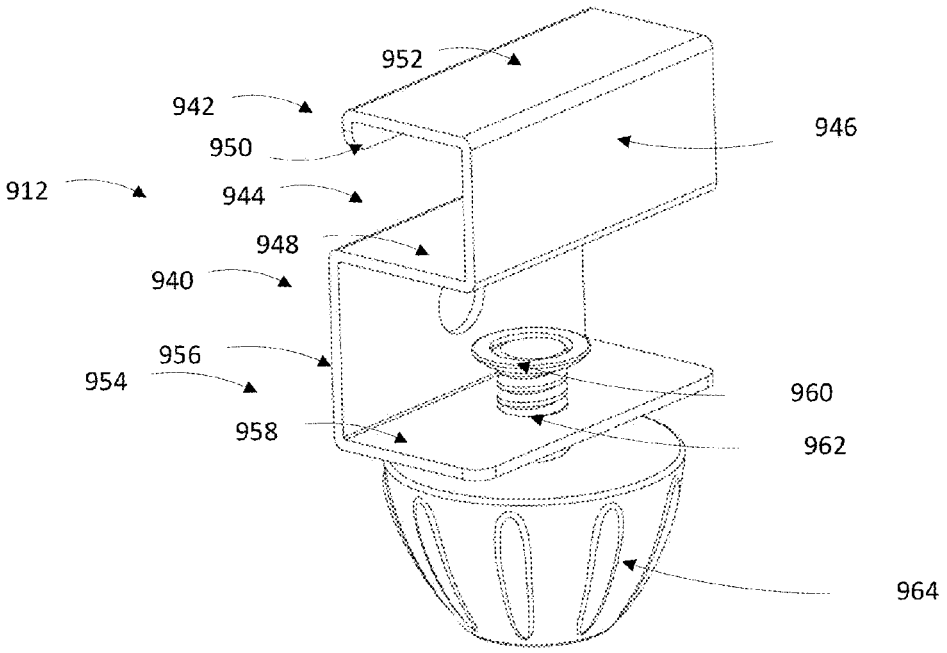
FIG. 9F depicts a perspective view of another embodiment of the securing unit of FIG. 1.

FIG. 9F depicts a perspective view of another embodiment of the securing unit 912. The securing unit 912 includes clamping unit 940 that is substantially S-shaped. The upper portion 942 of the clamping unit 940 includes an opening 944 that is sized to accommodate the end portion 908 of the frame 906. The end portion 908 is positioned in the opening 944 such that a back wall 946, a bottom wall 948 and front ledge 950 and top wall 952 are in contact with the end portion 908 securing the end portion 908 to the clamping unit 940. The lower portion 954 of the clamping unit 940 is separated from the upper portion 942 by the bottom wall 948 of the upper portion 942. The lower portion 954 includes a back wall 956 and bottom wall 958 with a screw 960 extending through a threaded opening 962 in the bottom wall 958. The screw 960 is sized such that it extends from the bottom wall 958 of the lower portion 954 to the a side of the bottom wall 948 of the upper portion 942 facing the bottom wall. An end of the screw 960 on the outside of the clamping unit 940 includes a handle 964 that allows the screw 960 to turn to travel through the threaded opening.

An opening 966 in the lower portion 954 formed by the back wall 956, bottom wall 958, and bottom wall 948 of the lower portion 954 is sized to accommodate the arm of a chair 902. After the arm of the chair 902 is positioned in the lower portion 954, the screw 960 is turned such that the bottom wall 958 is removably affixed to the arm of the chair 902. The securing unit 912 is removed from the chair 902 by loosening the screw 960 and removing the arm of the chair 902 from the opening. The clamping unit 940 and screw 960 can be made of any rigid material including steel, aluminum, plastic or any other rigid material. In another embodiment, the screw 960 is positioned through an threaded opening through the back wall 956 of the lower portion 954. In another embodiment, screws 960 may pass through threaded openings in both the bottom wall 958 and the back wall 956 of the clamping unit 940. By using the clamping unit 940, the end portion 908 of the frame 906 can be removably affixed to the arm of a chair 902.

In another embodiment, the chair shade 900 is secured to the ground using stakes coupled to the end portions 908 of the chair shade 900. In one embodiment, the end portions include pointed ends that can secure the chair shade 900 into the ground. In another embodiment, the stake includes a central pin with a spiral edge extending down the length of the pin. The spiral edge is configured to auger the stake into the ground to secure the chair shade into the ground. The spike may attach to the end portions of the frame by a rope, string, rod, or any other securing mechanism.

Figure 10A:
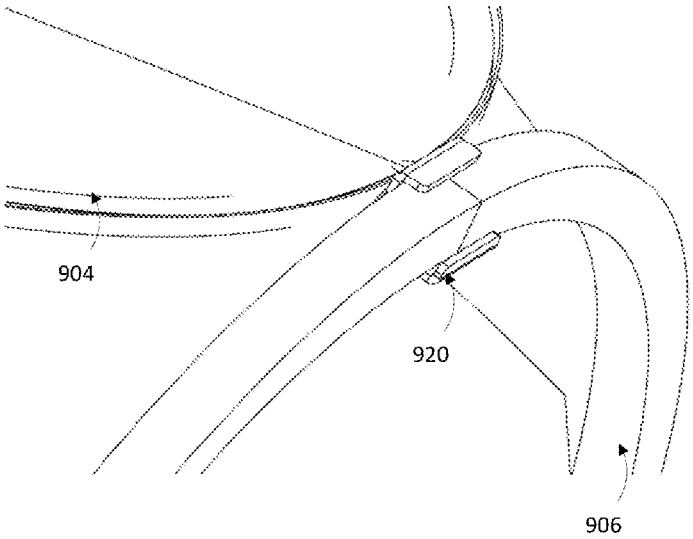
FIG. 10A depicts a perspective view of the sliding unit of FIG. 9B.

FIG. 10A depicts a perspective view of the sliding unit 920. The sliding unit 920 has a substantially U shaped opening that is sized to engage the surfaces of the frame 906 such that the sliding unit 906 is secured to the frame 906, but is able to move along the length of the frame 906. A rear surface of the sliding unit 920 is affixed to support frame 922 of the canopy 904 such that the canopy 904 moves along with the sliding unit 920 along the frame 906.

Figure 10B:
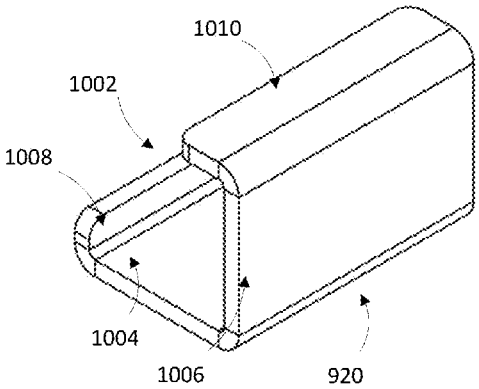
FIG. 10B depicts a side perspective view of the sliding unit of FIG. 10A.

FIG. 10B depicts a side perspective view of the sliding unit 920. The sliding unit 920 includes a central opening 1002 created by a lower wall 1004, a back wall 1006, a front extension 1008 and a top extension 1010. The central opening 1002 is sized such that the central opening 1002 engages the frame such that the sliding unit 920 can slide along the frame 906 if sufficient force is applied to the sliding unit 920, and remains stationary on the frame when no force is applied to the sliding unit 920. The support frame 922 of the canopy 904 may be secured to the outside surface 1012 of the back wall 1006 by any known method of securing the support structure 922 including, but not limited to, welding, an adhesive, or any other method of securing the support structure 922 to the sliding unit 920. In one embodiment, the sliding unit 920 includes an adjustable pin or screw passing through a threaded opening in the back wall 1006 that secures the sliding unit 922 in a position on the frame 906. Consistent with this embodiment, the sliding unit 922 may be moved when the pin or screw is loosened, and may be locked in position when the pin or screw is tightened such that the pin or screw is in contact with the frame 906.

Figure 10C:
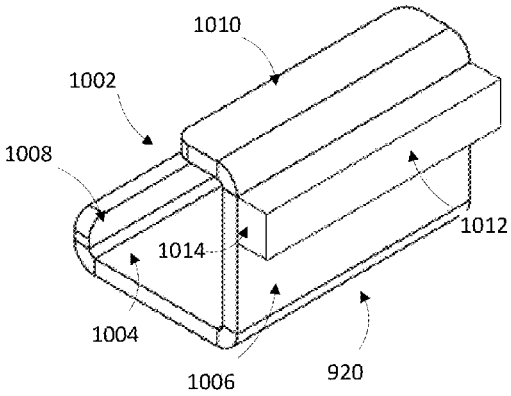
FIG. 10C depicts a side perspective view of a slider unit of FIG. 10A including a support structure sleeve.

FIG. 10C depicts a side perspective view of a slider unit 912 having a support structure sleeve 1012. The support structure sleeve 1012 includes an opening 1014 sized to engage the support structure 922 of the canopy 904. In one embodiment, the size of the opening 1014 is sized such that the support structure is held in a specific position relative to the chair 902. In another embodiment, the opening 1014 is sized such that the canopy 904 may be tilted at a different angle relative to the frame 906. As an illustrative example, the opening 1014 may be sized such that the canopy 904 is substantially perpendicular to the back wall 1006 of the sliding unit 930. In another embodiment, the opening 1014 may be sized such that the canopy 904 may be tilted at an angle relative to the back wall 1006 of the sliding unit 920. The angle may be any angle between 0 and 180 degrees.

Figure 11A:
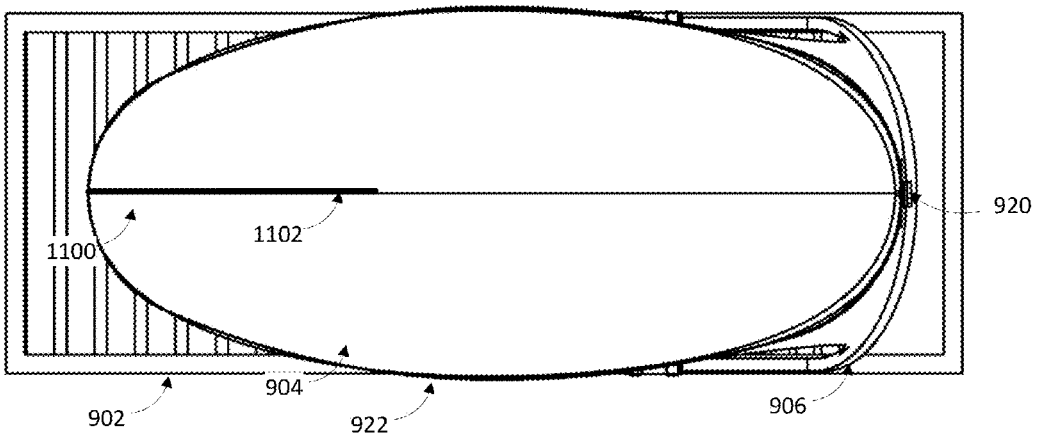
FIG. 11A depicts the canopy of FIG. 9A including an opening portion.

FIG. 11A depicts the canopy 904 including an opening portion 1100. The opening portion 1100 includes a slit 1102 cut into the fabric of the canopy 904 such that the opening portion 1100 is separated into two separate portions. The slit 1102 extends from an edge of the frame 922 farthest from the sliding unit 920 to a point near the center of the canopy 904. In one embodiment, the slit 1102 extends the entire length of the canopy 904. In another embodiment, the slit 1102 extends to substantially the center of the canopy 904. In another embodiment, the slit 1102 extends from the side of the support frame 922 closest to the sliding unit 920 to the center of the canopy 904. I another embodiment, the slit 1102 extends from the side of the frame furthest from the sliding unit 920 to a point between the center of the canopy 904 and the side of the canopy 904 farthest from the sliding unit 920. The two portions are removably affixed to one another by a joining unit. The joining unit may be a zipper, snaps, buttons, latch and hook strips, or any other device to removably secure the two portions together.

Figure 11B:
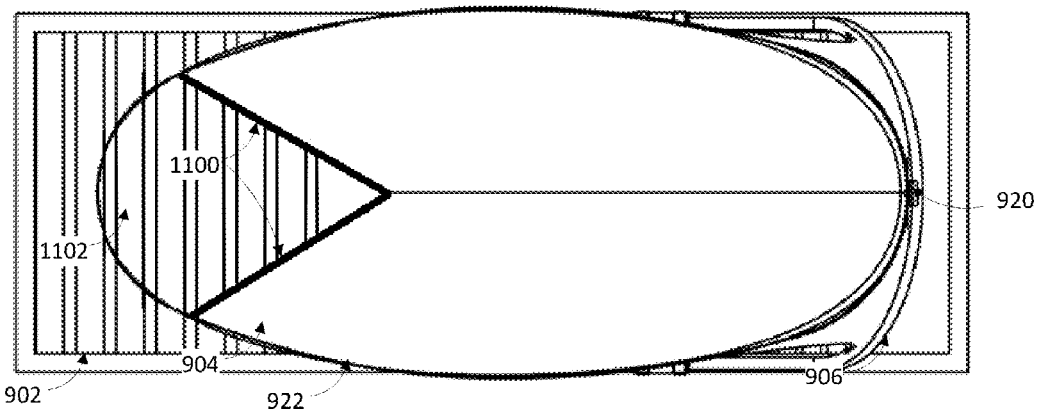
FIG. 11B depicts the canopy of FIG. 9A with the two portions of the opening portion separated.

FIG. 11B depicts the canopy 904 with the two portions of the opening portion 1100 separated. The peripheral edges of each portion is configured to slide along the support frame 922 such that a substantial area of the opening portion 1100 is open. A latching device, such as a snap, button, rope or strap, affixed to the canopy 904 or the support frame 922 may secure each portion in the open position. The opening portion 1100 may be closed by moving each portion along the support frame 922 in a direction towards each other and securing the two portions together using the joining unit.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A chair shade including:
a chair;
a cover sheet;
a frame having a first end and a second end;
a sliding unit having a bottom wall, back wall and top wall forming a substantially U shaped opening that is sized to accommodate the frame; and
a securing unit that secures the first end and second end of the frame to corresponding opposite sides of the chair,
wherein
the U shaped opening of the sliding unit is slidably affixed to the frame such that the U shaped opening of the sliding unit moves along the length of the frame when a force is applied and maintains its position on the frame when no force is applied, and
the cover sheet is secured to the sliding unit on a side of the back wall opposite the U shaped opening.

2. The chair shade of claim 1, wherein the cover sheet extends along substantially the entire length of the chair.

3. The chair shade of claim 1, wherein the frame has a substantially U shape.

4. The chair shade of claim 1, wherein the cover sheet includes a support structure along a periphery of the cover sheet, and the support structure is affixed to the rear wall of the sliding unit.

5. The chair shade of claim 1, wherein the cover sheet is positioned at an angle relative to the sliding unit.

6. The chair shade of claim 1, wherein the cover sheet is made of a material that prevents the transmission of light.

7. The chair shade of claim 6, wherein the cover sheet is made of a tightly woven nylon.

8. The char shade of claim 4, wherein a support frame is made of a material having memory characteristics.

9. The chair shade of claim 1, wherein the securing unit is a latch and hook strap.

10. The chair shade of claim 1, wherein the support structure is made of a material having a memory characteristic.

11. The chair of claim 1 wherein the cover sheet includes a support frame affixed to the periphery of the cover sheet.

12. The chair of claim 11, wherein the cover sheet includes an opening portion formed by a slit in the canopy between the center of the cover sheet and the support frame.

13. The chair of claim 12, wherein the opening includes two portions removablly affixed by a joining unit.

14. The chair of claim 12, wherein a surface of the chair is exposed to light when the two portions are slid along the support frame.

* * * * *